US008925168B2

(12) United States Patent
Srivatsan et al.

(10) Patent No.: US 8,925,168 B2
(45) Date of Patent: Jan. 6, 2015

(54) APPARATUS AND METHOD FOR REPAIRING A SURFACE SUBMERGED IN LIQUID BY CREATING A WORKABLE SPACE

(75) Inventors: Akshay Srivatsan, Palo Alto, CA (US); Narayanan Srivatsan, Palo Alto, CA (US)

(73) Assignee: Akshay Srivatsan, Palo Alto, CA (US)

( * ) Notice: Subject to any disclaimer, the term of this patent is extended or adjusted under 35 U.S.C. 154(b) by 217 days.

(21) Appl. No.: 13/308,670

(22) Filed: Dec. 1, 2011

(65) Prior Publication Data

US 2013/0139369 A1 Jun. 6, 2013

(51) Int. Cl.
*B23P 6/00* (2006.01)

(52) U.S. Cl.
USPC ..... 29/402.09; 29/402.13; 29/402.16; 29/402.18; 29/402.19; 29/402.01

(58) Field of Classification Search
USPC ..... 29/402.01, 402.09, 402.11, 402.13, 29/402.16, 402.18, 402.19
See application file for complete search history.

(56) References Cited

U.S. PATENT DOCUMENTS

| | | | | | |
|---|---|---|---|---|---|
| 3,424,203 | A * | 1/1969 | Rubenstein | 138/98 |
| 4,075,971 | A * | 2/1978 | Reginensi et al. | 440/54 |
| 4,996,940 | A * | 3/1991 | Cleary | 118/306 |
| 5,348,613 | A * | 9/1994 | Blais | 156/579 |
| 5,465,881 | A * | 11/1995 | Zwicky | 222/389 |
| 6,064,708 | A * | 5/2000 | Sakamaki | 376/249 |
| 6,219,399 | B1 * | 4/2001 | Naruse et al. | 376/245 |
| 6,555,779 | B1 * | 4/2003 | Obana et al. | 219/121.63 |
| 7,267,019 | B2 * | 9/2007 | Morris et al. | 73/865.8 |
| 7,641,526 | B1 * | 1/2010 | Bekker | 440/54 |
| 7,769,123 | B2 * | 8/2010 | Rowell et al. | 376/249 |
| 8,111,802 | B2 * | 2/2012 | Rowell et al. | 376/249 |
| 8,291,564 | B2 * | 10/2012 | Jones et al. | 29/402.01 |
| 8,371,025 | B2 * | 2/2013 | Kramer et al. | 29/824 |
| 2005/0265510 | A1 * | 12/2005 | Jennings et al. | 376/260 |
| 2007/0125190 | A1 * | 6/2007 | Morris et al. | 73/865.8 |

(Continued)

FOREIGN PATENT DOCUMENTS

| | | | | |
|---|---|---|---|---|
| DE | 10347857 | A1 * | 5/2005 | E04H 4/14 |
| JP | 05031591 | A * | 2/1993 | B23K 26/12 |
| KR | 2004004731 | A * | 1/2004 | |
| KR | 2004025715 | A * | 3/2004 | |

OTHER PUBLICATIONS

Machine English translation of DE 10347857.*
Machine English translation of JP 05031591.*

*Primary Examiner* — Essama Omgba

(57) ABSTRACT

An apparatus and method for performing repair on the floor or side wall of a swimming pool or of a large body of liquid by creating a workable space without fully draining the water or liquid. The apparatus utilizes a sturdy solid tube to create a separation between the area enclosed within the tube and body of liquid outside. A guiding lid with multiple openings allows a specific tool to be guided into the tube for conducting repairs. A draining assembly drains the liquid enclosed within the tube. A drier assembly creates a dry workable space within the tube. A repair assembly is used to conduct a specific repair operation including spray painting, filling up holes, filling in caulking to cover up cracks, sanding within the workable space. An inspection assembly is used to remotely inspect the surface that needs repair.

10 Claims, 4 Drawing Sheets

(56) References Cited

U.S. PATENT DOCUMENTS

| | | | | |
|---|---|---|---|---|
| 2007/0140403 | A1* | 6/2007 | Yuguchi et al. | 376/249 |
| 2008/0205575 | A1* | 8/2008 | Morris et al. | 376/249 |
| 2008/0317192 | A1* | 12/2008 | Rowell et al. | 376/249 |
| 2009/0175686 | A1* | 7/2009 | Kruger | 405/52 |
| 2010/0192368 | A1* | 8/2010 | Kramer et al. | 29/824 |
| 2011/0089645 | A1* | 4/2011 | White | 277/637 |
| 2013/0036962 | A1* | 2/2013 | Van Der Kam et al. | 114/268 |
| 2013/0145594 | A1* | 6/2013 | Kramer et al. | 29/402.01 |

* cited by examiner

APPARATUS AND METHOD FOR REPAIRING A SURFACE SUBMERGED IN LIQUID BY CREATING A WORKABLE SPACE

BACKGROUND

The present invention relates generally to repairing surfaces that are submerged in a liquid at all times and need repair from time to time, such as floors or sides of swimming pools, outer surface of ships, inside surface of oil tanker etc. and more particularly to an innovative system of creating a workable space around the surface that needs repair and performing such repair without completely draining the entire body of liquid.

Swimming pools, both in-ground and above ground varieties, abound in homes, clubs, and community centers across several countries. Pool water require weekly or daily maintenance to maintain the right circulation of water through a filtration system to remove dust particles/leaves etc., maintain the right PH level, and introduce the right level of chemicals to prevent growth of algae. However, the introduction of chemicals as well as natural elements such as earthquakes, exposure of surfaces to sun or algae growth over long periods of time can cause wear and tear on the submerged surfaces of the pool such as cracks in the floor or side wall of the pool, peeling of paint or discoloration. Repairing the pool, when the pool is filled, however, is cumbersome due to the body of water covering the surface to be repaired. Conducting such repairs typically requires one to drain the water and empty the pool, if the repair needs to be done on the floor of the pool. For instance, even repairing a minor damage such as repairing a minor crack of few inches wide in the floor of the pool will require draining tens of thousands of gallons of water depending on pool size. Further, several cities have regulations around draining of pool water and thus the pool owner has to incur significant expenses of draining and then re-filling the pool and then bringing the pool water up to its original chemical composition by adding chemicals as the pool gets refilled.

A similar situation can arise in a ship, in transit, whose outer surface needs urgent repair in an area that is submerged under the water surface or an oil tanker that develops a leak that requires a surface submerged under the oil to be repaired without draining the entire quantity of oil in the container. In each case, it is tough to conduct the repair since the surface is submerged in a fluid during operation.

As such, what is needed is a repair device that allows one to conduct repairs at the damaged surface, by creating a workable space within the liquid in which the damaged surface is submerged, without having to empty the entire body of liquid it is submerged in.

SUMMARY

This invention discloses an apparatus and method for performing repair on the floor or side wall of a swimming pool or a surface submerged in a large body of liquid by creating a workable space without fully draining the water or liquid. A sturdy solid tube whose height exceeds the maximum depth of the pool is introduced into the pool to create a separation between the areas enclosed within the tube and body of liquid outside. Liquid tight seals are mounted at the end of the tube immersed in liquid to prevent leakage between the inside and outside of the tube. A guiding lid with multiple openings is mounted at the other end of the tube above the level of liquid. Each opening in the guiding lid allows one specific tool to be guided into the tube for conducting repairs. A draining assembly comprising a suction pump at one end and an extensible tube at the other end is inserted into one of the openings in the guiding lid to drain the liquid enclosed within the tube. The liquid enclosed within the tube and drained by the draining assembly is stored in a liquid storage container. A drier assembly comprising an air blower at one end and an extensible tube at the other end that is inserted into one of the openings in the guiding lid to create a dry workable space within the tube. A repair assembly comprising a feeder for introducing materials used in repair including paint, cement, caulking compound at one end and an extensible tube at the other end is inserted into one of the openings in the guiding lid. The repair assembly comprises one or more attachments to conduct a specific repair operation including spray painting, filling up holes, filling in caulking to cover up cracks, sanding within the workable space. An inspection assembly comprising a display-monitor at one end and an extensible tube containing a camera or an imaging device at the other end is inserted into one of the openings in the guiding lid to inspect the surface before, after and during repair. Once the repair and inspection are completed to satisfaction, the pool or large body of liquid is re-filled with the drained water/liquid stored in the storage container.

The construction and method of operation of the invention, however, together with additional objectives and advantages thereof will be best understood from the following description of specific embodiments when read in connection with the accompanying drawings.

DESCRIPTION

The invention claimed here enables performing repair on the floor or sides of a swimming pool or a surface submerged in a large body of liquid without fully draining the liquid, by creating a workable space within the liquid.

Figure 1:
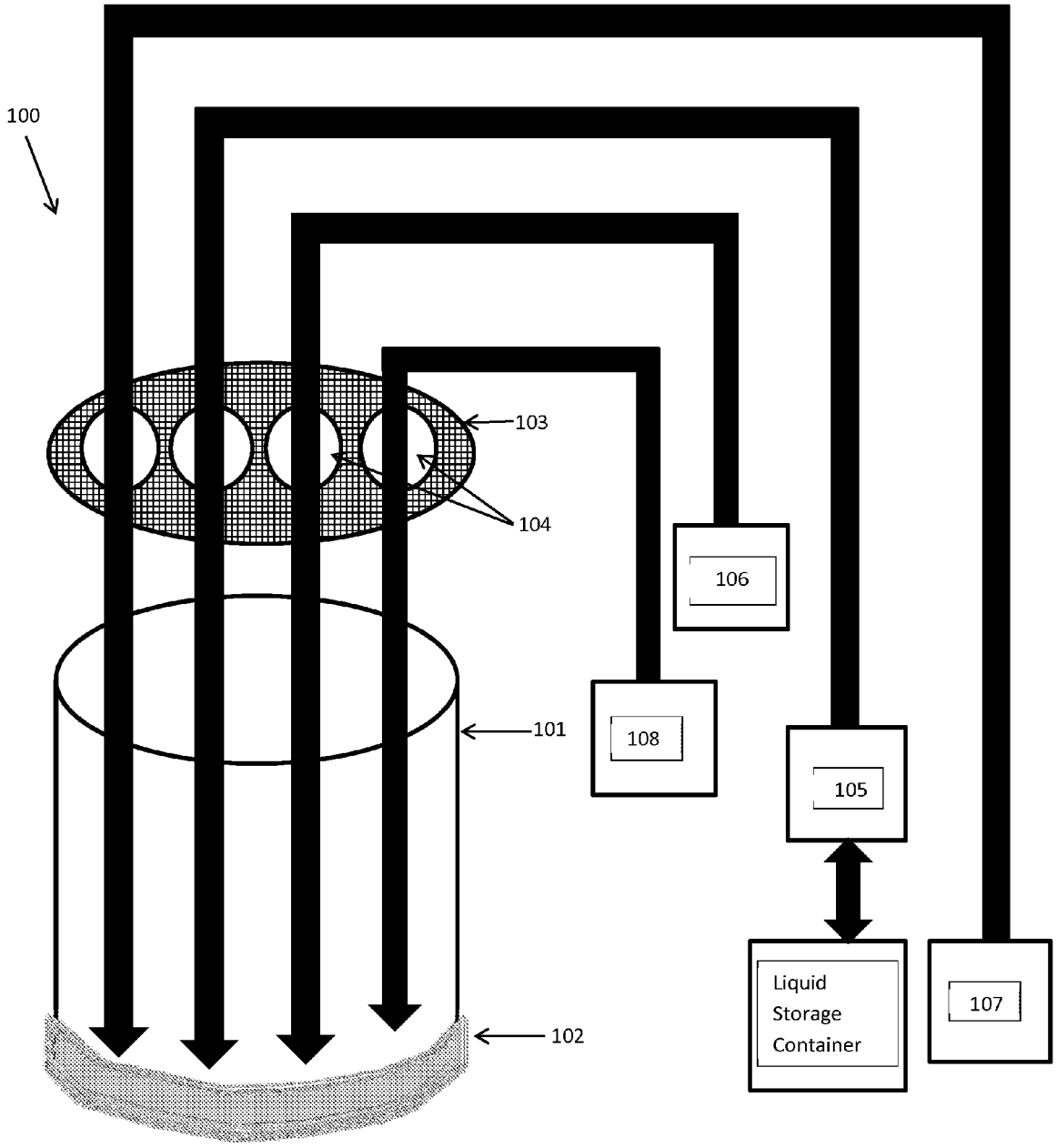
FIG. 1 illustrates the apparatus according to one embodiment of the invention.

FIG. 1 illustrates an apparatus 100 performing repair on the floor or side wall of a swimming pool or a surface submerged in a large body of liquid creating a workable space in accordance with one embodiment of the present invention. The apparatus 100 illustrated in FIG. 1 utilizes a sturdy solid tube 101 whose height exceeds the maximum depth of the pool to create a separation between the areas enclosed within the tube and body of liquid outside. Liquid tight seals 102 are mounted at the end of the tube immersed in liquid to prevent leakage between the inside and outside of the tube. A guiding lid 103 with multiple openings is mounted at the other end of the tube above the level of liquid. Each opening 104 in the guiding lid allows one specific tool to be guided into the tube for conducting repairs. A draining assembly 105 comprising a suction pump at one end and an extensible tube at the other end is inserted into one of the openings in the guiding lid to drain the liquid enclosed within the tube. The liquid enclosed within the tube and drained by the draining assembly is stored in a liquid storage container. A drier assembly 106 comprising an air blower at one end and an extensible tube at the other end that is inserted into one of the openings in the guiding lid to create a dry workable space within the tube. A repair assembly 107 comprising a feeder for introducing materials used in repair including paint, cement, caulking compound at one end and an extensible tube at the other end is inserted into one of the openings in the guiding lid 103. The repair assembly 107 comprises one or more attachments to conduct a specific repair operation including spray painting, filling up holes, filling in caulking to cover up cracks, sanding within the workable space. An inspection assembly 108 comprising a monitor at one end and an extensible tube containing a camera or an imaging device at the other end is inserted into one of the openings in the guiding lid to inspect the surface before, after and during repair. Once the repair and inspection are completed to satisfaction, the pool or large body of liquid is re-filled with the drained water/liquid stored in the storage container.

Figure 2A:
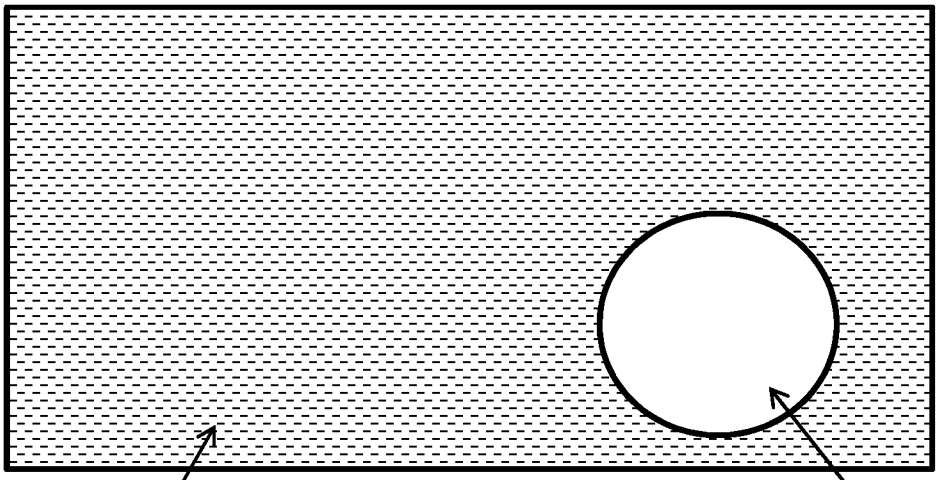
FIGS. 2*a* and 2*b* illustrate the top and side views respectively of the apparatus according to one embodiment of the present invention where the repair is needed on the floor of the pool.
Figure 2B:
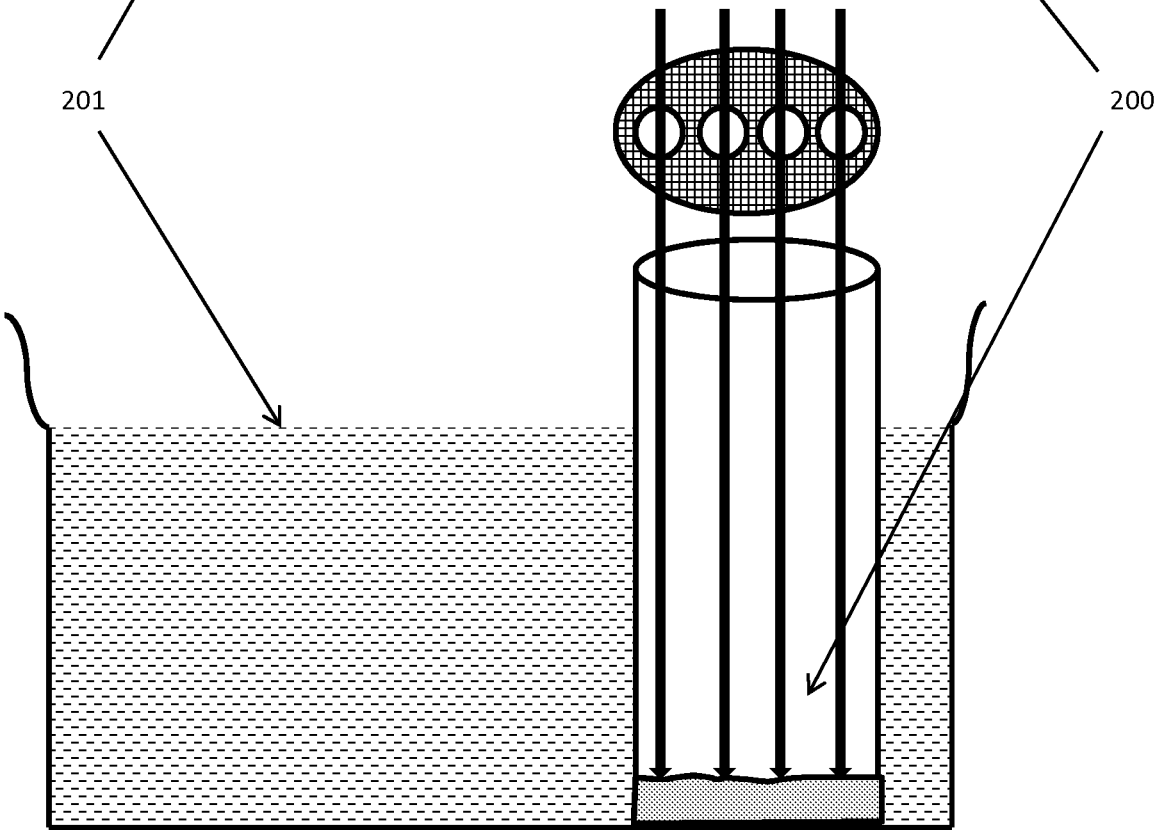

FIGS. 2*a* and 2*b* illustrate the top and side views respectively of the apparatus according to one embodiment of the present invention where the repair is needed at the floor of the pool. In this embodiment, a circular cross-section is used for the tube to create the workable space 200 within the body of water 201. The size of the tube can be altered depending on the area to be repaired. In one embodiment the size of the tube is such that only remote repair and inspection is possible. In another embodiment, the size of the tube is such that a technician can manually perform repairs on the surface of the pool.

Figure 3A:
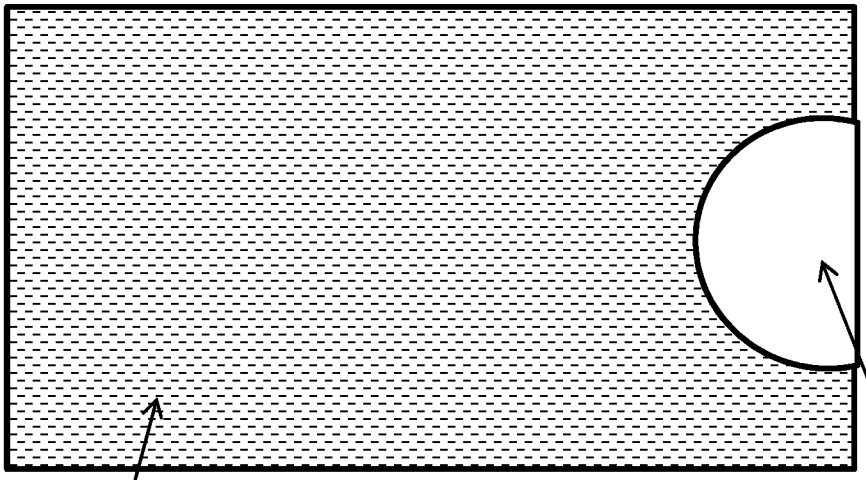
FIGS. 3*a* and 3*b* illustrate the top and side views respectively of the apparatus according to another embodiment of the present invention where the repair is needed on one of the inside walls of the pool.
Figure 3B:
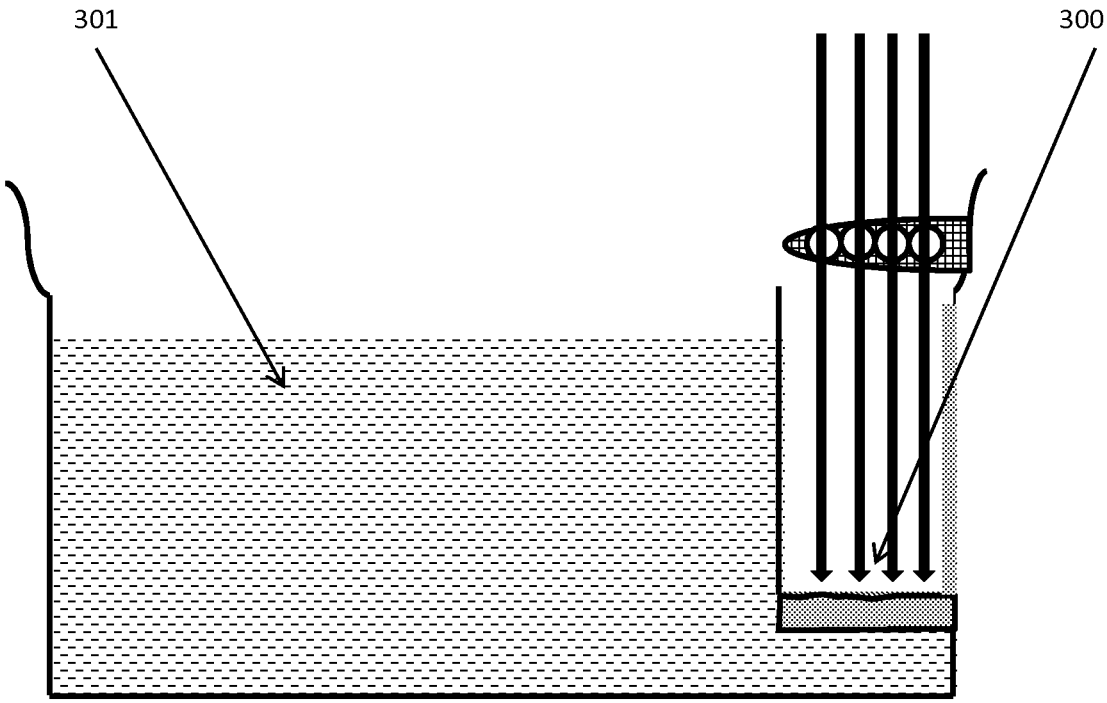

FIGS. 3*a* and 3*b* illustrate the top and side views respectively of the apparatus according to another embodiment of the present invention where the repair is needed on one of the inside walls of the pool. In such case, the cross-section of the tube is altered as shown in FIGS. 3*a* and 3*b* so that the workable space 300 can be created within the body of water 301.

Figures 4A, 4B:
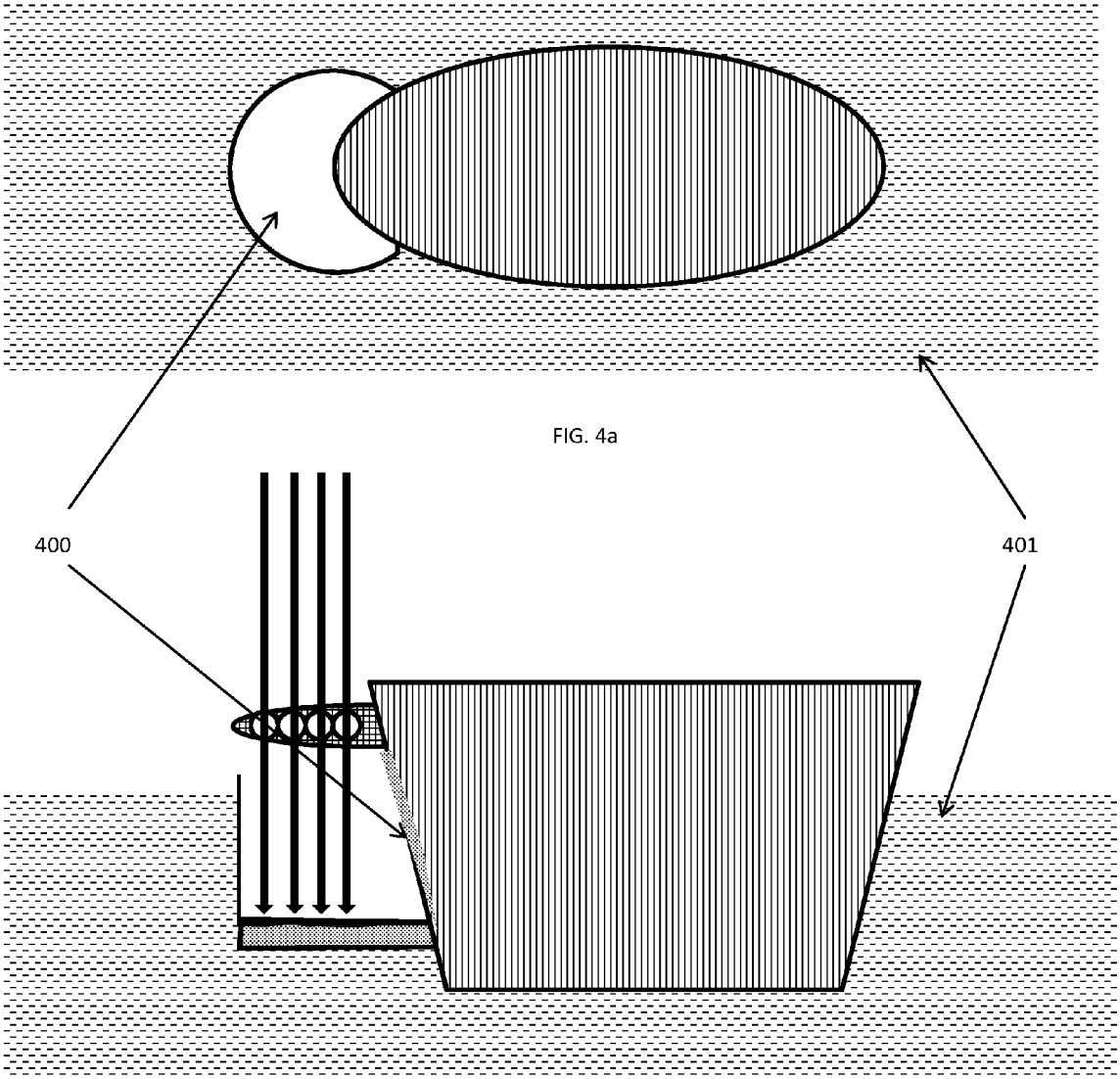
FIGS. 4*a* and 4*b* illustrate the front and side views respectively of the apparatus according to yet another embodiment of the present invention where the repair is needed on one of the outside walls of a sailing vessel.

FIGS. 4*a* and 4*b* illustrate the top and side views respectively of the apparatus according to yet another embodiment of the present invention where the repair is on one of the outside walls of a sailing vessel. In such case, the cross-section of the tube is altered as shown in FIGS. 4*a* and 4*b* so that the workable space 400 can be created within the body of water 401.

The method for performing repair on the floor of a swimming pool or a surface submerged in a large body of liquid using the apparatus 100 of FIG. 1 is as follows. Insert the sturdy solid tube 101 in to the body of liquid, such as the swimming pool, position the tube so that it rests on the floor of the pool or at the submerged surface within the body of liquid such that the area requiring repair is fully enclosed within the tube and the liquid-tight seal 102 at the bottom of the tube is flush with surface being repaired. Drain the water/liquid from the inside of the tube using the draining assembly 105 to create a workable space within the volume enclosed by the tube. Optionally store the extracted liquid in a liquid storage container. Introduce the drier assembly 106 into the tube and extend it down to the surface being repaired to dry/clean surface and create a workable space. Perform repair operations including one or more of spray painting, filling up holes, filling in caulking to cover up cracks, sanding on the workable space on floor of the pool or submerged surface within the body of liquid by extending the repair assembly 107 within the workable space. Introduce the inspection assembly 108 and inspect the workable space. If satisfied with the results, refill liquid from the liquid storage container in to the pool or the body of liquid and remove the apparatus 100 from the pool or body of liquid.

The method for performing repair on the inside wall of a swimming pool as shown in FIGS. 3*a* and 3*b* or outside wall of a surface submerged in a large body of liquid as shown in FIGS. 4*a* and 4*b* using the apparatus is as follows. Insert the sturdy solid semi-circular half section of a tube in to the body of liquid, and position the tube so that the area requiring repair is within the tube. The liquid tight seals mounted at the sides and lower end of the semi-circular tube immersed in liquid to prevent leakage between the inside and outside of the tube. Drain the water/liquid from the inside of the tube using the draining assembly to create a workable space within the volume enclosed by the tube. Optionally store the extracted liquid in a liquid storage container. Introduce the drier assembly into the tube and extend it to the surface being repaired to dry/clean surface and create a workable space. Perform repair operations including one or more of spray painting, filling up holes, filling in caulking to cover up cracks, sanding on the workable space on the side walls of the pool or submerged surface within the body of liquid by extending the repair assembly within the workable space. Introduce the inspection assembly and inspect the workable space. If satisfied with the results, refill liquid from the liquid storage container in to the pool or the body of liquid and remove the apparatus from the pool or body of liquid.

What is claimed is a unique method to conduct repair on a surface submerged in a liquid, without draining the entire body of liquid, using a specially designed apparatus as disclosed. The surface could be an internal surface which holds the body of liquid, such as the floor or side wall of a swimming pool or an external surface enclosed by a body of liquid such as the external surface of a shipping vessel. The apparatus includes a tube that encloses the surface to be repaired, liquid tight seals at its edges, a guiding lid with a plurality of openings that allow guiding of repair operations to the surface including a draining assembly for draining fluids, a drier assembly for drying the surface to be repaired, repair assembly to introduce caulking compound, paint or sanding tools, an inspection assembly to introduce camera or imaging device before, during and after the repair. The apparatus allows for a person to manually conduct repair inside the tube by removing the guiding lid or utilize the multiple assemblies connected to the guiding lid and conduct a remote repair without entering the tube.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A method for performing repairs on the floor of a swimming pool or any surface submerged in a large body of liquid by creating a workable space without fully draining the liquid comprising:

providing an apparatus comprising:

a sturdy solid tube, whose height exceeds the maximum depth of the pool, that can be introduced into the pool to create a separation between the areas enclosed within the tube and the body of liquid outside;

wherein the material of the tube is any one of metal or a polymer capable of withstanding high liquid pressure;

wherein the thickness and material of the tube are chosen such that the buoyant force of the liquid on the tube is less than the weight of the tube, allowing the tube to stay immersed in the liquid;

wherein the diameter of the tube is large enough to accommodate a person to enter the workable space to perform manual repair;

liquid tight seals mounted at the end of the tube immersed in liquid to prevent leakage between the inside and outside of the tube;

a guiding lid, with a plurality of openings, mounted at the other end of the tube above the level of liquid, each opening allowing a specific tool to be guided into the tube for conduct repairs;

a draining assembly comprising a suction pump at one end and an extensible tube at the other end that can be inserted into one of the openings in the guiding lid to drain the liquid enclosed within the tube;

a liquid storage container connected to the extensible tube to store liquid drained by the draining assembly;

a drier assembly comprising an air blower at one end and an extensible tube at the other end that can be inserted into one of the openings in the guiding lid to create a dry workable space within the tube;

a repair assembly comprising a feeder for introducing materials needed during repair including paint, cement, caulking compound at one end and an extensible tube at the other end that can be inserted into one of the openings in the guiding lid containing one or more attachments to conduct a specific repair operation including spray painting, filling up holes, filling in caulking to cover up cracks, sanding within the workable space;

an inspection assembly comprising a display monitor at one end and an extensible tube containing a camera or an imaging device at the other end that can be inserted into one of the openings in the guiding lid to inspect the surface that needs repair;

inserting the sturdy solid tube into the body of liquid;

positioning the tube so that it rests on the floor of the pool or at the submerged surface within the body of liquid such that the area requiring repair is fully enclosed within the tube and the liquid-tight seal at the bottom of the tube is flush with the surface being repaired;

draining the water/liquid from the inside of the tube using the draining assembly to create a workable space within the volume enclosed by the tube;

storing the extracted liquid in a liquid storage container;

introducing the drier assembly into the tube and extending it down to the surface being repaired to dry/clean the surface and create a workable space;

performing repair operations including one or more of spray painting, filling up holes, filling in caulking to cover up cracks, sanding on the workable space on the floor of the pool or submerged surface within the body of liquid by extending the repair assembly within the workable space;

introducing the inspection assembly and inspecting the workable space;

refilling liquid from the liquid storage container in to the pool or the body of liquid;

removing the apparatus from the pool or body of liquid;

whereby the repair is completed on the floor of a swimming pool or the bottom surface of a large body of liquid without fully draining the liquid.

2. The method as in claim 1, wherein the shape of the tube is tailored to the surface being repaired such as creating a work surface that fits flush on the floor.

3. The method as in claim 1, wherein the camera in the inspection assembly is wireless.

4. The method as in claim 1, where the imaging device in the inspection assembly uses one or more of infra-red scanning, ultrasound mapping of the surface being repaired.

5. The method as in claim 1, where the signals from the camera or imaging device can automatically trigger one or more control actions including lowering the attachment, adjusting the flow of paint or cement and retracting the repair assembly.

6. A method for performing repairs on the side wall of a swimming pool or any surface submerged in a large body of liquid by creating a workable space without fully draining the liquid comprising:

providing an apparatus comprising:

a sturdy solid semi-circular half section of a tube whose height exceeds the maximum depth of the pool that can be introduced into the pool to create a separation between the area enclosed within the tube and the body of liquid outside;

wherein the material of the tube is any one of metal or a polymer capable of withstanding high liquid pressure;

wherein the thickness and material of the tube are chosen such that the buoyant force of the liquid on the tube is less than the weight of the tube, allowing the tube to stay immersed in the liquid;

wherein the diameter of the tube is large enough to accommodate a person to enter the workable space to perform manual repair;

liquid tight seals mounted at the sides and lower end of the semi-circular tube immersed in liquid to prevent leakage between the inside and outside of the tube;

a guiding lid with one or more openings mounted at the other end of the semi-circular tube above the level of liquid, each opening allowing a specific tool to be guided into the tube for conduct repairs;

a draining assembly comprising a suction pump at one end and an extensible tube at the other end that can be inserted into one of the openings in the guiding lid to drain the liquid enclosed within the semi-circular tube;

a liquid storage container connected to the extensible tube to store liquid drained by the draining assembly;

a drier assembly comprising an air blower at one end and an extensible tube at the other end that can be inserted into one of the openings in the guiding lid to create a dry workable space within the semi-circular tube;

a repair assembly comprising a feeder for introducing materials used in repair including paint, cement, caulking compound at one end and an extensible tube at the other end that can be inserted into one of the openings in the guiding lid containing one or more attachments to conduct a specific repair operation including spray painting, filling up holes, filling in caulking to cover up cracks, sanding within the workable space;

an inspection assembly comprising a display monitor at one end and an extensible tube containing a camera or an imaging device at the other end that can be inserted into one of the openings in the guiding lid to inspect the surface that needs repair;

inserting the sturdy solid semi-circular tube into the body of liquid;

positioning the semi-circular tube so that it rests on the side wall of the pool or the body of liquid such that the area requiring repair is fully enclosed within the tube and the liquid-tight seal at the sides and bottom of the semi-circular tube is flush with the surface being repaired;

draining the water/liquid from the inside of the semi-circular tube using the draining assembly to create a workable space within the volume enclosed by the semi-circular tube;

storing the extracted liquid in a liquid storage container;

introducing the drier assembly into the semi-circular tube and extending it down to the surface being repaired to dry/clean surface and create a workable space;

performing repair operations including one or more of spray painting, filling up holes, filling in caulking to cover up cracks, sanding on the workable space on side wall of the pool or the body of liquid by extending the repair assembly within the workable space;

introducing the inspection assembly and inspecting the workable space;

refilling liquid from the liquid storage container in to the pool or the body of liquid;

removing the apparatus from the pool or body of liquid;

whereby the repair is completed on the side wall of a swimming pool or the side surface of a large body of liquid without fully draining the liquid.

7. The method as in claim 6, wherein the shape of the tube is tailored to the surface being repaired such as creating a work surface that fits flush on the side wall.

8. The method as in claim 6, wherein the camera in the inspection assembly is wireless.

9. The method as in claim 6, where the imaging device in the inspection assembly uses one or more of infra-red scanning, ultrasound mapping of the surface being repaired.

10. The method as in claim 6, where the signals from the camera or imaging device can automatically trigger one or more control actions including lowering the attachment, adjusting the flow of paint or cement and retracting the repair assembly.

* * * * *